US009165561B2

(12) United States Patent
Wu

(10) Patent No.: US 9,165,561 B2
(45) Date of Patent: Oct. 20, 2015

(54) APPARATUS AND METHOD FOR PROCESSING VOICE SIGNAL

(71) Applicant: HON HAI PRECISION INDUSTRY CO., LTD., New Taipei (TW)

(72) Inventor: Chun-Te Wu, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 12 days.

(21) Appl. No.: 14/153,075

(22) Filed: Jan. 13, 2014

(65) Prior Publication Data

US 2014/0214412 A1 Jul. 31, 2014

(30) Foreign Application Priority Data

Jan. 29, 2013 (CN) ..... 2013 1 00334224

(51) Int. Cl.
*G10L 19/018* (2013.01)
*G10L 25/90* (2013.01)

(52) U.S. Cl.
CPC ..... *G10L 19/018* (2013.01); *G10L 25/90* (2013.01)

(58) Field of Classification Search
CPC ..... G10L 19/24; G10L 19/00; G10L 19/018; G10L 25/90
See application file for complete search history.

(56) References Cited

U.S. PATENT DOCUMENTS

| | | | | |
|---|---|---|---|---|
| 6,307,140 | B1 * | 10/2001 | Iwamoto | 84/622 |
| 6,370,507 | B1 * | 4/2002 | Grill et al. | 704/500 |
| 8,629,342 | B2 * | 1/2014 | Lee et al. | 84/610 |
| 2004/0196913 | A1 * | 10/2004 | Chakravarthy et al. | 375/254 |
| 2006/0280271 | A1 * | 12/2006 | Oshikiri | 375/355 |
| 2010/0017198 | A1 * | 1/2010 | Yamanashi et al. | 704/205 |
| 2011/0106547 | A1 * | 5/2011 | Toraichi et al. | 704/501 |
| 2011/0314995 | A1 * | 12/2011 | Lyon et al. | 84/609 |

* cited by examiner

*Primary Examiner* — Richemond Dorvil
*Assistant Examiner* — Kee Young Lee
(74) *Attorney, Agent, or Firm* — Novak Druce Connolly Bove + Quigg LLP

(57) ABSTRACT

A voice signal processing method processes voice signals acquired by a microphone. A voice processing device acquires first voice signals according to a first sampling frequency, and samples second voice signals from the first voice signals according to a second sampling frequency. The second voice signals are encoded to obtain a basic voice package. A voiceprint data package of each voice signal frame of the first voice signals is obtained using a curve fitting method, and a pitch data package of each voice signal frame of the first voice signals is obtained according to pitch distribution of twelve central octave keys of a standard piano. The voiceprint data package and the pitch data package are embedded into the basic audio package to generate a final voice package of the first voice signals.

16 Claims, 4 Drawing Sheets

APPARATUS AND METHOD FOR PROCESSING VOICE SIGNAL

BACKGROUND

1. Technical Field

Embodiments of the present disclosure relate to voice signal processing technologies, and particularly, to an apparatus and method for processing voice signals.

2. Description of Related Art

Voice communication products, such as video phones and Skype® are widely used. These products acquire voices using a predetermined sampling frequency (e.g., 8 KHz or 44.1 KHz) to obtain voice signals. The acquired voice signals are encoded using standard voice codec protocols (e.g., G.711) to obtain basic voice packages. The basic voice packages are transmitted to the other communication device to realize voice communication. However, this manner of processing the voice signals does not distinguish high frequency portions and low frequency portions of the voice signals. Thus, the basic voice packages can have poor acoustic quality. Therefore, there is room for improvement in the art.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean "at least one."

Figure 1:
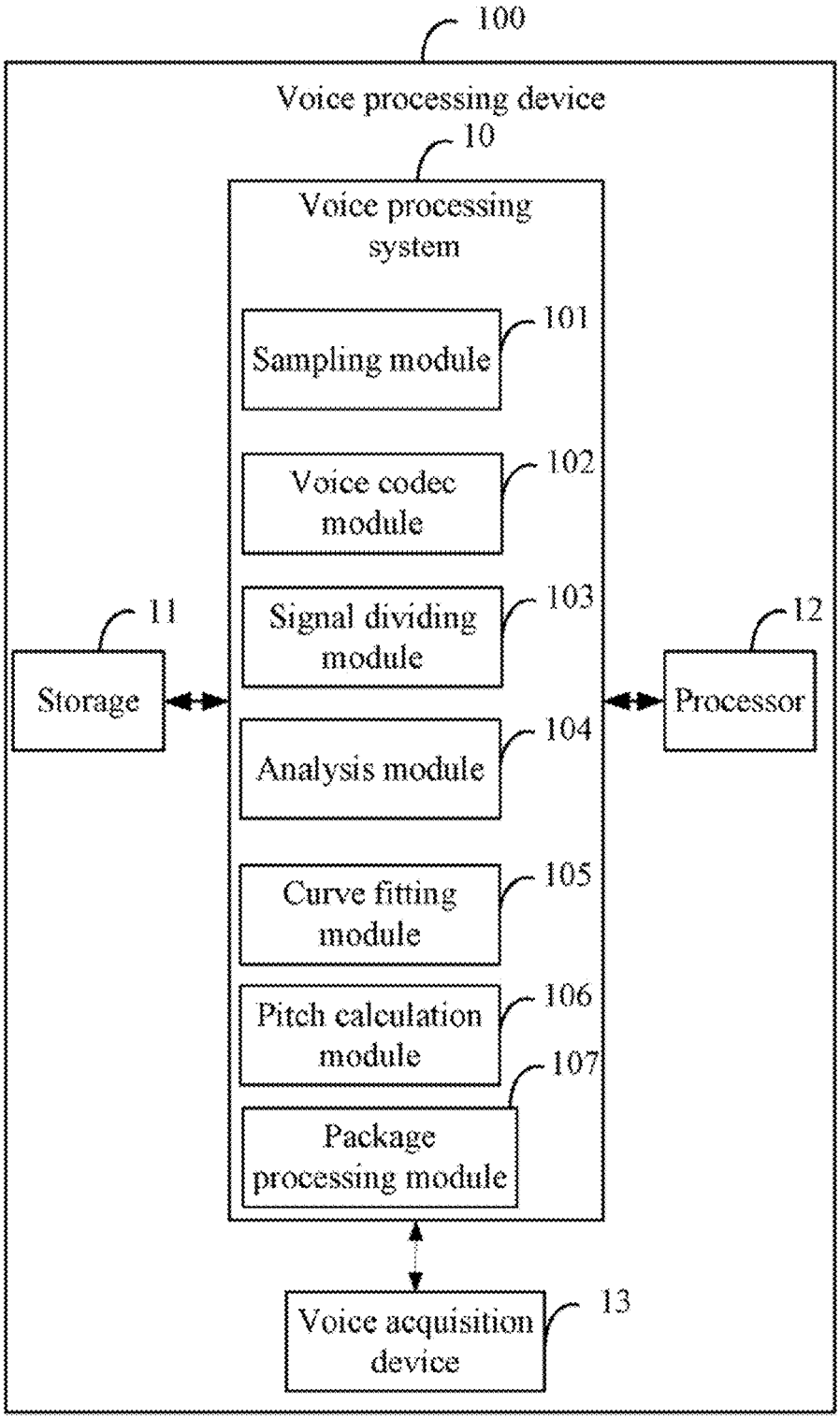
FIG. 1 is a schematic block diagram illustrating one embodiment of a voice processing device.

FIG. 1 is a schematic block diagram illustrating one embodiment of a voice processing device 100. The voice processing device 100 includes a voice processing system 10, a storage 11, a processor 12, and a voice acquisition device 13. The voice acquisition device 13 is configured to acquire voices, which can be a microphone supporting sampling frequencies of 8 KHz, 44.1 KHZ, and 48 KHz, for example. The voice processing device 100 can be a video phone, a fixed phone, a smart phone, or other similar voice communication device. FIG. 1 shows one example of the voice processing device 100, and it can include more or less components than those shown in the embodiment, or have a different configuration of the components.

The voice processing system 10 includes a plurality of programs in the form of one or more computerized instructions stored in the storage 11 and executed by the processor 12 to perform operations of the voice processing device 100. In the embodiment, the voice processing system 10 includes a sampling module 101, a voice codec module 102, a signal dividing module 103, an analysis module 104, a curve fitting module 105, a pitch calculation module 106, and a package processing module 107. The storage 11 may be an external or embedded storage medium of the first electronic device 100, such as a secure digital memory (SD) card, a Trans Flash (TF) card, a compact flash (CF) card, or a smart media (SM) card.

In general, the word "module," as used herein, refers to logic embodied in hardware or firmware, or to a collection of software instructions, written in a programming language, such as, Java, C, or assembly. One or more software instructions in the modules may be embedded in firmware, such as in an erasable programmable read only memory (EPROM). The modules described herein may be implemented as either software and/or hardware modules and may be stored in any type of non-transitory computer-readable medium or other storage devices. Some non-limiting examples of non-transitory computer-readable medium include CDs, DVDs, BLU-RAY, flash memory, and hard disk drives.

Figure 2:
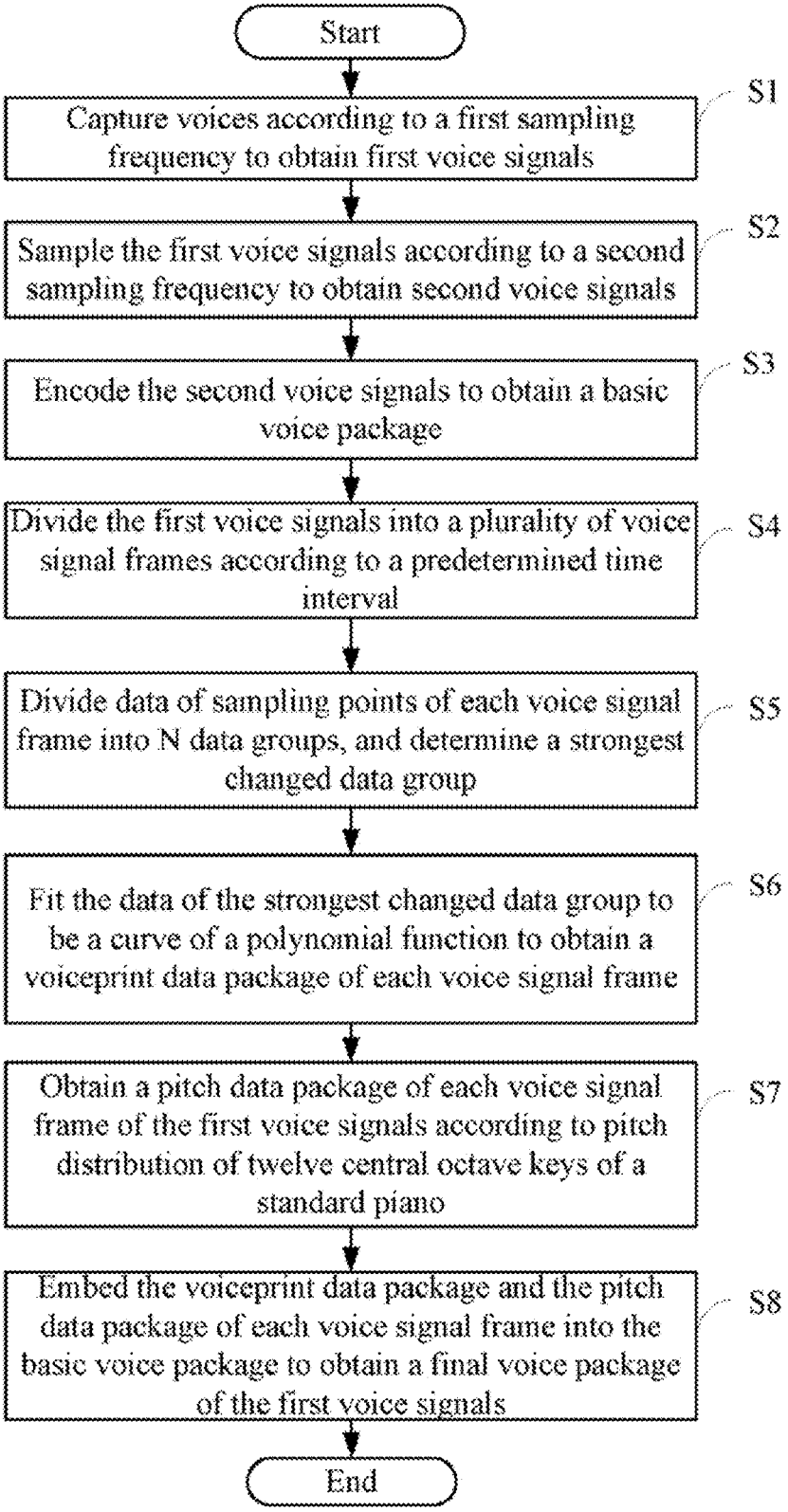
FIG. 2 is a flowchart of one embodiment of a voice signal processing method using the voice processing device of FIG. 1.

FIG. 2 shows a flowchart of one embodiment of a voice signal processing method using the functional modules of the voice processing system 10 of FIG. 1. Depending on the embodiment, additional steps may be added, others removed, and the ordering of the steps may be changed.

In step S1, the sampling module 101 controls the voice acquisition device 13 to acquire voices according to a first sampling frequency to obtain first voice signals. The first voice signals are stored in a buffer of the storage 11.

In step S2, the sampling module 101 samples the first voice signals of the buffer according to a second sampling frequency to obtain second voice signals. In this embodiment, the second sampling frequency is less than the first sampling frequency, and the first sampling frequency is an integer multiple of the second sampling frequency. For example, the first sampling frequency is 48 KHz and the second sampling frequency is 8 KHz.

In step S3, the voice codec module 102 encodes the second voice signals to obtain a basic voice package. In the embodiment, the voice codec module 102 can encode the second voice signals according to an international voice codec standard protocol, such as G.711, G.723, G.726, G.729, or iLBC. The basic voice package is a voice over internet protocol (VoIP) package.

In step S4, the signal dividing module 103 divides the first voice signals into a plurality of voice signal frames according to a predetermined time interval. In this embodiment, the predetermined time interval is 100 milliseconds (ms). Each voice signal frame includes data of 4800 sampling points within a time period of 100 ms.

In step S5, the analysis module 104 divides data of sampling points of each voice signal frame into N data groups $D_1$, $D_2, \ldots, D_i, \ldots, D_N$, and determines a strongest changed data group of the N data groups. In this embodiment, N is equal to the second sampling frequency (e.g., 8 KHz). Each data group includes data of M sampling points, where M is equal to a ratio of the first sampling frequency (e.g., 48 KHz) to the second sampling frequency (e.g., 8 KHz). The data of each sampling point is defined to be an acoustic intensity (e.g., 3 DB) of voice signals of each of the sampling points acquired by the sampling module 101.

In the embodiment, the strongest changed data group is determined as follows. First, the analysis module 104 calculates an average value Kavg of data of each data group $D_i$ and an absolute value $Kabs_j$ of each data of each data group $D_i$, wherein $1 \leq j \leq M$. Second, the analysis module 104 calculates a difference between the absolute value $Kabs_j$ of each data of each data group $D_i$ and the average value Kavg of the data of the corresponding data group $D_i$. Third, the analysis module 104 calculates a summation of the calculated differences corresponding to each data group $D_i$. The summation corresponding to each data group D is calculated according to a formula of $$Kerror_i = \sum_{1 \le j \le M} (Kabs_j - Kavg),$$

$$1 \le i \le N,$$

wherein the $Kerror_i$ represents the summation corresponding to the data group $D_i$ and is stored in an array B[i]. Then, one of the N data groups corresponding to a maximum value $Kerror_{imax}$ of the array B[i] is determined to be the strongest changed data group.

In step S6, the curve fitting module 105 fits the data of the strongest changed data group to be a curve of a polynomial function to obtain coefficients of the polynomial function, and encodes each of the coefficients of the polynomial function to obtain a voiceprint data package of each voice signal frame. For example, each of the coefficients is encoded to a hexadecimal number to form the voiceprint data package. In one example, the voiceprint data package is {03, 1E, 4B, 6A, 9F, AA}. In this embodiment, the polynomial function is a function of a five polynomial function, such as $f(X)=C_5X^5+C_4X^4+C_3X^3+C_2X^2+C_1X+C_0$. The coefficients of the polynomial function include $C_0$, $C_1$, $C_2$, $C_3$, $C_4$, and $C_5$.

Figure 3:
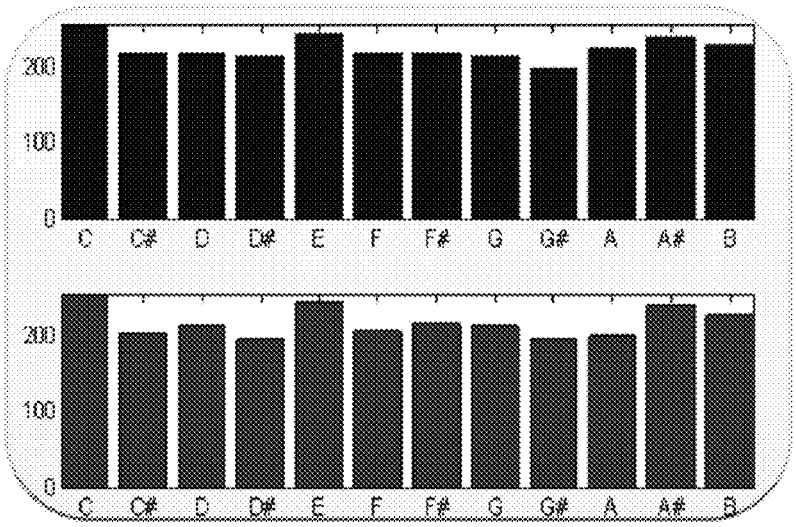
FIG. 3 shows a schematic view of pitch data packages corresponding to two voice signal frames.

In step S7, the pitch calculation module 106 calculates frequency distribution range of each voice signal frame, and calculates an acoustic intensity of each voice signal frame relative to a pitch of each of twelve center octave keys of a standard piano according to the frequency distribution range of each voice signal frame. Then, each calculated acoustic intensity relative to the pitch of each of the twelve center octave keys of the standard piano is encoded to a byte of a hexadecimal number to form a pitch data package of each voice signal frame. The pitch data package of each voice signal frame includes twelve bytes of data, such as {FF, CB, A3, 91, 83, 7B, 6F, 8C, 9D, 80, A5, B8}. The twelve center octave keys of the standard piano include tonal keys of C4, C4#, D4, D4#, E4, F4, F4#, G4, G4#, A4, A4#, and B4. The pitch of the twelve center octave keys is distributed in a predetermined frequency interval, such as [261 Hz, 523 Hz]. An embodiment of the pitch data package of each voice signal is shown in FIG. 3. In this embodiment, the pitch calculation module 106 can calculate the frequency distribution of each voice signal frame using a known autocorrelation calculation algorithm. In addition, the pitch calculation module 106 only needs to analyze voice signals within the predetermined frequency interval of each voice signal frame to obtain the acoustic intensity of each voice signal frame relative to the pitch of each of the twelve center octave keys of the standard piano.

In the embodiment, the pitch of the C4 tonal key is distributed in a first frequency interval of [261.63 Hz, 277.18 Hz]. An average value of acoustic intensities of sampling points of each voice signal frame located within the first frequency interval is defined to be the acoustic intensity of the voice signal frame relative to the pitch of the C4 tonal key.

The pitch of the C4# tonal key is distributed in a second frequency interval of [277.18 Hz, 293.66 Hz]. An average value of acoustic intensities of sampling points of each voice signal frame located within the second frequency interval is defined to be the acoustic intensity of the voice signal frame relative to the pitch of the C4# tonal key.

The pitch of the D4 tonal key is distributed in a third frequency interval of [293.66 Hz, 311.13 Hz]. An average value of acoustic intensities of sampling points of each voice signal frame located within the third frequency interval is defined to be the acoustic intensity of the voice signal frame relative to the pitch of the D4 tonal key.

The pitch of the D4# tonal key is distributed in a fourth frequency interval of [311.13 Hz, 329.63 Hz]. An average value of acoustic intensities of sampling points of each voice signal frame located within the fourth frequency interval is defined to be the acoustic intensity of the voice signal frame relative to the pitch of the D# key.

The pitch of the E4 tonal key is distributed in a fifth frequency interval of [329.63 Hz, 349.23 Hz]. An average value of acoustic intensities of sampling points of each voice signal frame located within the fifth frequency interval is defined to be the acoustic intensity of the voice signal frame relative to the pitch of the E4 tonal key.

The pitch of the F4 tonal key is distributed in a sixth frequency interval of [349.23 Hz, 369.99 Hz]. An average value of acoustic intensities of sampling points of each voice signal frame located within the sixth frequency interval is defined to be the acoustic intensity of the voice signal frame relative to the pitch of the F4 tonal key.

The pitch of the F4# tonal key is distributed in a seventh frequency interval of [369.99 Hz, 392.00 Hz]. An average value of acoustic intensities of sampling points of each voice signal frame located within the seventh frequency interval is defined to be the acoustic intensity of the voice signal frame relative to the pitch of the F4# tonal key.

The pitch of the G4 tonal key is distributed in an eighth frequency interval of [392.00 Hz, 415.30 Hz]. An average value of acoustic intensities of sampling points of each voice signal frame located within the eighth frequency interval is defined to be the acoustic intensity of the voice signal frame relative to the pitch of the G4 tonal key.

The pitch of the G4# tonal key is distributed in a ninth frequency interval of [415.30 Hz, 440.00 Hz]. An average value of acoustic intensities of sampling points of each voice signal frame located within the ninth frequency interval is defined to be the acoustic intensity of the voice signal frame relative to the pitch of the G4# tonal key.

The pitch of the A4 tonal key is distributed in a tenth frequency interval of [440.00 Hz, 466.16 Hz]. An average value of acoustic intensities of sampling points of each voice signal frame located within the tenth frequency interval is defined to be the acoustic intensity of the voice signal frame relative to the pitch of the A4 tonal key.

The pitch of the A4# tonal key is distributed in an eleventh frequency interval of [466.16 Hz, 493.88 Hz]. An average value of acoustic intensities of sampling points of each voice signal frame located within the eleventh frequency interval is defined to be the acoustic intensity of the voice signal frame relative to the pitch of the A4# tonal key.

The pitch of the B4 tonal key is distributed in a twelfth frequency interval of [493.88 Hz, 523.00 Hz]. An average value of acoustic intensities of sampling points of each voice signal frame located within the twelfth frequency interval is defined to be the acoustic intensity of the voice signal frame relative to the pitch of the B4 tonal key.

Figure 4:
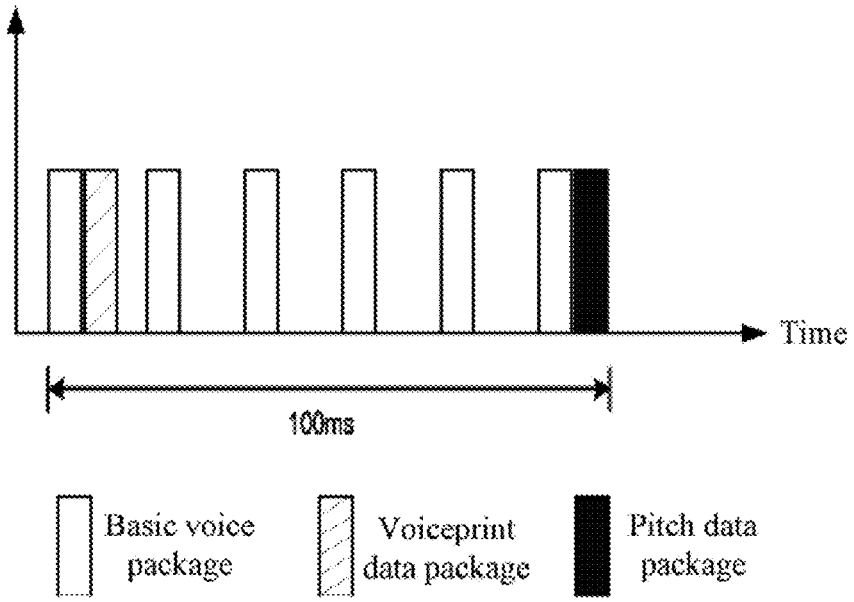
FIG. 4 shows a schematic view of a voiceprint data package and a pitch data package embedded into a basic voice package.

In step S8, the package processing module 107 embeds the voiceprint data package and the pitch data package of each voice signal frame into the basic voice package to obtain a final voice package of the first voice signals. In this embodiment, as shown in FIG. 4, the pitch data package and the voiceprint data package are staggered with each other in the final voice package. When the voice processing device 100 establishes a voice communication with an external device, the voice processing device 100 processes voices of a user as described above, and then transmits the final voice package to the external device. Thus, the quality of the voice communication can be improved.

Although certain embodiments of the present disclosure have been specifically described, the present disclosure is not to be construed as being limited thereto. Various changes or modifications may be made to the present disclosure without departing from the scope and spirit of the present disclosure.

What is claimed is:

1. A computerized voice processing method implemented by a voice processing device having a voice acquisition device, the method comprising:

controlling the voice acquisition device to acquire voices according to a first sampling frequency to obtain first voice signals;

sampling the first voice signals according to a second sampling frequency to obtain second voice signals, wherein the second sampling frequency is less than the first sampling frequency, and the first sampling frequency is an integer multiple of the second sampling frequency;

coding the second voice signals to obtain a basic voice package;

dividing the first voice signals into a plurality of voice signal frames according to a predetermined time interval;

dividing data of sampling points of each voice signal frame into N data groups D1, D2, . . . , Di, . . . , DN, wherein $1 \le i \le N$;

determining a strongest changed data group of the N data groups, comprising:

calculating an average value Kavg of data of each data group Di and an absolute value Kabsj of each data of each data group Di, wherein $1 \le j \le M$;

calculating a difference between the absolute value Kabsj of each data of each data group Di and the average value Kavg of the data of the corresponding data group Di; and calculating a summation of calculated differences corresponding to each data group D according to a formula of $$Kerror_i = \sum_{1 \le j \le M} (Kabs_j - Kavg),$$

$$1 \le i \le N,$$

wherein Kerrori represents the summation corresponding to the data group Di and is stored in an array B[i], and one of the N data groups corresponding to a maximum value $Kerror_{imax}$ of the array B[i] is determined to be a strongest changed data group;

fitting the data of the strongest changed data group to be a curve of a polynomial function to obtain coefficients of the polynomial function, and coding each of the coefficients of the polynomial function to a hexadecimal number to form a voiceprint data package of each voice signal frame;

calculating a frequency distribution range of each voice signal frame, and calculating an acoustic intensity of each voice signal frame relative to a pitch of each of twelve center octave keys of a standard piano according to the frequency distribution range of each voice signal frame, to obtain a pitch data package of each voice signal frame according to the acoustic intensity of each voice signal frame relative to a pitch of each of twelve center octave keys of a standard piano; and embedding the voiceprint data package and the pitch data package of each voice signal frame into the basic voice package to obtain a final voice package of the first voice signals.

2. The method according to claim 1, wherein the first sampling frequency is 48 KHz and the second sampling frequency is 8 KHz.

3. The method according to claim 1, wherein the predetermined time interval is 100 milliseconds (ms).

4. The method according to claim 1, wherein the polynomial function is a quintic function represented as $f(X)=C_5X^5+C_4X^4+C_3X^3+C_2X^2+C_1X+C_0$, the coefficients of the polynomial function including $C_0$, $C_1$, $C_2$, $C_3$, $C_4$, and $C_5$.

5. The method according to claim 1, wherein the acoustic intensity of each voice signal frame relative to the pitch of each of the twelve center octave keys of the standard piano is encoded to a byte of a hexadecimal number to form the pitch data package of each voice signal frame, and the pitch data package includes twelve bytes of hexadecimal numbers.

6. The method according to claim 1, wherein the twelve center octave keys of the standard piano include tonal keys of C4, C4#, D4, D4#, E4, F4, F4#, G4, G4#, A4, A4#, and B4, wherein:

the pitch of the C4 tonal key is distributed in a first frequency interval of [261.63 Hz, 277.18 Hz], and an average value of acoustic intensities of sampling points of each voice signal frame located within the first frequency interval is defined to be the acoustic intensity of the voice signal frame relative to the pitch of the C4 tonal key;

the pitch of the C4# tonal key is distributed in a second frequency interval of [277.18 Hz, 293.66 Hz], and an average value of acoustic intensities of sampling points of each voice signal frame located within the second frequency interval is defined to be the acoustic intensity of the voice signal frame relative to the pitch of the C4# tonal key;

the pitch of the D4 tonal key is distributed in a third frequency interval of [293.66 Hz, 311.13 Hz], and an average value of acoustic intensities of sampling points of each voice signal frame located within the third frequency interval is defined to be the acoustic intensity of the voice signal frame relative to the pitch of the D4 tonal key;

the pitch of the D4# tonal key is distributed in a fourth frequency interval of [311.13 Hz, 329.63 Hz], and an average value of acoustic intensities of sampling points of each voice signal frame located within the fourth frequency interval is defined to be the acoustic intensity of the voice signal frame relative to the pitch of the D# key;

the pitch of the E4 tonal key is distributed in a fifth frequency interval of [329.63 Hz, 349.23 Hz], and an average value of acoustic intensities of sampling points of each voice signal frame located within the fifth frequency interval is defined to be the acoustic intensity of the voice signal frame relative to the pitch of the E4 tonal key;

the pitch of the F4 tonal key is distributed in a sixth frequency interval of [349.23 Hz, 369.99 Hz], and an average value of acoustic intensities of sampling points of each voice signal frame located within the sixth frequency interval is defined to be the acoustic intensity of the voice signal frame relative to the pitch of the F4 tonal key;

the pitch of the F4# tonal key is distributed in a seventh frequency interval of [369.99 Hz, 392.00 Hz], and an average value of acoustic intensities of sampling points of each voice signal frame located within the seventh frequency interval is defined to be the acoustic intensity of the voice signal frame relative to the pitch of the F4# tonal key;

the pitch of the G4 tonal key is distributed in an eighth frequency interval of [392.00 Hz, 415.30 Hz], and an average value of acoustic intensities of sampling points of each voice signal frame located within the eighth frequency interval is defined to be the acoustic intensity of the voice signal frame relative to the pitch of the G4 tonal key;

the pitch of the G4# tonal key is distributed in a ninth frequency interval of [415.30 Hz, 440.00 Hz], and an average value of acoustic intensities of sampling points of each voice signal frame located within the ninth frequency interval is defined to be the acoustic intensity of the voice signal frame relative to the pitch of the G4# tonal key;

the pitch of the A4 tonal key is distributed in a tenth frequency interval of [440.00 Hz, 466.16 Hz], and an average value of acoustic intensities of sampling points of each voice signal frame located within the tenth frequency interval is defined to be the acoustic intensity of the voice signal frame relative to the pitch of the A4 tonal key;

the pitch of the A4# tonal key is distributed in an eleventh frequency interval of [466.16 Hz, 493.88 Hz], and an average value of acoustic intensities of sampling points of each voice signal frame located within the eleventh frequency interval is defined to be the acoustic intensity of the voice signal frame relative to the pitch of the A4# tonal key; and the pitch of the B4 tonal key is distributed in a twelfth frequency interval of [493.88 Hz, 523.00 Hz], and an average value of acoustic intensities of sampling points of each voice signal frame located within the twelfth frequency interval is defined to be the acoustic intensity of the voice signal frame relative to the pitch of the B4 tonal key.

7. The method according to claim 1, wherein the second voice signals are encoded according to an international voice codec standard protocol.

8. The method according to claim 1, wherein the basic voice package is a voice over internet protocol package.

9. A voice processing device, comprising:

a voice acquisition device;

a storage;

a processor; and one or more programs executed by the processor to perform a method of:

controlling the voice acquisition device to acquire voices according to a first sampling frequency to obtain first voice signals;

sampling the first voice signals according to a second sampling frequency to obtain second voice signals; wherein the second sampling frequency is less than the first sampling frequency, and the first sampling frequency is an integer multiple of the second sampling frequency;

coding the second voice signals to obtain a basic voice package;

dividing the first voice signals into a plurality of voice signal frames according to a predetermined time interval;

dividing data of sampling points of each voice signal frame into N data groups D1, D2, . . . , Di, . . . , DN, wherein $1 \le i \le N$;

determining a strongest changed data group of the N data groups, comprising:

calculating an average value Kavg of data of each data group Di and an absolute value Kabsj of each data of each data group Di, wherein $1 \le j \le M$;

calculating a difference between the absolute value Kabsj of each data of each data group Di and the average value Kavg of the data of the corresponding data group Di; and calculating a summation of calculated differences corresponding to each data group D according to a formula of $$Kerror_i = \sum_{1 \le j \le M} (Kabs_j - Kavg),$$

$$1 \le i \le N,$$

wherein Kerrori represents the summation corresponding to the data group Di and is stored in an array B[i], and one of the data groups corresponding to a maximum value $Kerror_{imax}$ of the array B[i] is determined to be a strongest changed data group;

fitting the data of the strongest changed data group to be a curve of a polynomial function to obtain coefficients of the polynomial function, and coding each of the coefficients of the polynomial function to a hexadecimal number to form a voiceprint data package of each voice signal frame;

calculating a frequency distribution range of each voice signal frame, and calculating an acoustic intensity of each voice signal frame relative to a pitch of each of twelve center octave keys of a standard piano according to the frequency distribution range of each voice signal frame, to obtain a pitch data package of each voice signal frame according to the acoustic intensity of each voice signal frame relative to a pitch of each of twelve center octave keys of a standard piano; and embedding the voiceprint data package and the pitch data package of each voice signal frame into the basic voice package to obtain a final voice package of the first voice signals.

10. The voice processing device according to claim 9, wherein the first sampling frequency is 48 KHz and the second sampling frequency is 8 KHz.

11. The voice processing device according to claim 9, wherein the predetermined time interval is 100 milliseconds (ms).

12. The voice processing device according to claim 9, wherein the polynomial function is a quintic function represented as $f(X)=C_5X^5+C_4X^4+C_3X^3+C_2X^2+C_1X+C_0$, the coefficients of the polynomial function including $C_0$, $C_1$, $C_2$, $C_3$, $C_4$, and $C_5$.

13. The voice processing device according to claim 9, wherein the acoustic intensity of each voice signal frame relative to the pitch of each of the twelve center octave keys of the standard piano is encoded to a byte of a hexadecimal number to form the pitch data package of each voice signal frame, and the pitch data package includes twelve bytes of hexadecimal numbers.

14. The voice processing device according to claim 9, wherein the twelve center octave keys of the standard piano include tonal keys of C4, C4#, D4, D4#, E4, F4, F4#, G4, G4#, A4, A4#, and B4, wherein:

the pitch of the C4 tonal key is distributed in a first frequency interval of [261.63 Hz, 277.18 Hz], and an average value of acoustic intensities of sampling points of each voice signal frame located within the first frequency interval is defined to be the acoustic intensity of the voice signal frame relative to the pitch of the C4 tonal key;

the pitch of the C4# tonal key is distributed in a second frequency interval of [277.18 Hz, 293.66 Hz], and an average value of acoustic intensities of sampling points of each voice signal frame located within the second frequency interval is defined to be the acoustic intensity of the voice signal frame relative to the pitch of the C4# tonal key;

the pitch of the D4 tonal key is distributed in a third frequency interval of [293.66 Hz, 311.13 Hz], and an average value of acoustic intensities of sampling points of each voice signal frame located within the third frequency interval is defined to be the acoustic intensity of the voice signal frame relative to the pitch of the D4 tonal key;

the pitch of the D4# tonal key is distributed in a fourth frequency interval of [311.13 Hz, 329.63 Hz], and an average value of acoustic intensities of sampling points of each voice signal frame located within the fourth frequency interval is defined to be the acoustic intensity of the voice signal frame relative to the pitch of the D# key;

the pitch of the E4 tonal key is distributed in a fifth frequency interval of [329.63 Hz, 349.23 Hz], and an average value of acoustic intensities of sampling points of each voice signal frame located within the fifth frequency interval is defined to be the acoustic intensity of the voice signal frame relative to the pitch of the E4 tonal key;

the pitch of the F4 tonal key is distributed in a sixth frequency interval of [349.23 Hz, 369.99 Hz], and an average value of acoustic intensities of sampling points of each voice signal frame located within the sixth frequency interval is defined to be the acoustic intensity of the voice signal frame relative to the pitch of the F4 tonal key;

the pitch of the F4# tonal key is distributed in a seventh frequency interval of [369.99 Hz, 392.00 Hz], and an average value of acoustic intensities of sampling points of each voice signal frame located within the seventh frequency interval is defined to be the acoustic intensity of the voice signal frame relative to the pitch of the F4# tonal key;

the pitch of the G4 tonal key is distributed in an eighth frequency interval of [392.00 Hz, 415.30 Hz], and an average value of acoustic intensities of sampling points of each voice signal frame located within the eighth frequency interval is defined to be the acoustic intensity of the voice signal frame relative to the pitch of the G4 tonal key;

the pitch of the G4# tonal key is distributed in a ninth frequency interval of [415.30 Hz, 440.00 Hz], and an average value of acoustic intensities of sampling points of each voice signal frame located within the ninth frequency interval is defined to be the acoustic intensity of the voice signal frame relative to the pitch of the G4# tonal key;

the pitch of the A4 tonal key is distributed in a tenth frequency interval of [440.00 Hz, 466.16 Hz], and an average value of acoustic intensities of sampling points of each voice signal frame located within the tenth frequency interval is defined to be the acoustic intensity of the voice signal frame relative to the pitch of the A4 tonal key;

the pitch of the A4# tonal key is distributed in an eleventh frequency interval of [466.16 Hz, 493.88 Hz], and an average value of acoustic intensities of sampling points of each voice signal frame located within the eleventh frequency interval is defined to be the acoustic intensity of the voice signal frame relative to the pitch of the A4# tonal key; and the pitch of the B4 tonal key is distributed in a twelfth frequency interval of [493.88 Hz, 523.00 Hz], and an average value of acoustic intensities of sampling points of each voice signal frame located within the twelfth frequency interval is defined to be the acoustic intensity of the voice signal frame relative to the pitch of the B4 tonal key.

15. The voice processing device according to claim 9, wherein the second voice signals are encoded according to an international voice codec standard protocol.

16. The voice processing device according to claim 9, wherein the basic voice package is a voice over internet protocol package.

* * * * *